US006662611B2

(12) United States Patent
Janssen et al.

(10) Patent No.: US 6,662,611 B2
(45) Date of Patent: Dec. 16, 2003

(54) HYDROFORMING FLUSH SYSTEM

(75) Inventors: Andrease G. Janssen, Troy, MI (US); Frank A. Horton, Rochester Hills, MI (US)

(73) Assignee: Magna International, Inc., Aurora (CA)

( * ) Notice: Subject to any disclaimer, the term of this patent is extended or adjusted under 35 U.S.C. 154(b) by 0 days.

(21) Appl. No.: 10/204,000

(22) PCT Filed: Feb. 13, 2001

(86) PCT No.: PCT/CA01/00164

§ 371 (c)(1),
(2), (4) Date: Nov. 8, 2002

(87) PCT Pub. No.: WO01/62410

PCT Pub. Date: Aug. 30, 2001

(65) Prior Publication Data

US 2003/0131643 A1 Jul. 17, 2003

Related U.S. Application Data

(60) Provisional application No. 60/183,783, filed on Feb. 22, 2000.

(51) Int. Cl.[7] ..... B21D 9/15; B21D 26/02; B21D 28/28

(52) U.S. Cl. ..... 72/55; 83/54; 29/421.1

(58) Field of Search ..... 72/55, 56, 57; 29/421.1; 83/54

(56) References Cited

U.S. PATENT DOCUMENTS

| | | | | |
|---|---|---|---|---|
| 4,567,743 A | | 2/1986 | Cudini | |
| 4,989,482 A | * | 2/1991 | Mason | 83/54 |
| 5,070,717 A | | 12/1991 | Boyd et al. | |
| 5,107,693 A | | 4/1992 | Olszewski et al. | |
| 5,239,852 A | | 8/1993 | Roper | |
| 5,333,775 A | | 8/1994 | Bruggemann et al. | |
| 5,339,667 A | | 8/1994 | Shah et al. | |
| 5,398,533 A | | 3/1995 | Shimanovski et al. | |
| 5,718,048 A | | 2/1998 | Horton et al. | |
| 5,816,089 A | | 10/1998 | Marando | |
| 5,855,394 A | | 1/1999 | Horton et al. | |
| 5,899,498 A | | 5/1999 | Horton | |
| 5,979,201 A | | 11/1999 | Horton et al. | |
| 5,987,950 A | | 11/1999 | Horton | |
| 6,006,566 A | | 12/1999 | Huelsberg et al. | |
| 6,014,879 A | | 1/2000 | Jaekel et al. | |
| 6,067,830 A | | 5/2000 | Longhouse et al. | |
| 6,257,035 B1 | * | 7/2001 | Marks et al. | 72/57 |
| 6,260,393 B1 | * | 7/2001 | Engel et al. | 72/55 |
| 6,341,514 B2 | * | 1/2002 | Engel et al. | 72/55 |
| 6,401,507 B1 | * | 6/2002 | Krcek et al. | 72/55 |
| 6,442,820 B1 | * | 9/2002 | Mason | 29/421.1 |
| 6,591,648 B1 | * | 7/2003 | Ash et al. | 72/55 |

FOREIGN PATENT DOCUMENTS

| | | |
|---|---|---|
| DE | 196 47 962 | 4/1998 |
| EP | 0 588 528 | 3/1994 |

* cited by examiner

*Primary Examiner*—David B. Jones
(74) *Attorney, Agent, or Firm*—Pillsbury Winthrop LLP

(57) ABSTRACT

A hydroforming assembly has a plurality of die structures that are mounted on a press for reciprocating movement between open and closed conditions. The die structures have cooperating die surfaces defining a die cavity when in the closed condition and receive a metallic tube blank when in the open conditions. A hydroforming fluid supply system has tube-end engaging structures that are movable to selectively and sealingly engage opposite ends of the tube blank. The hydroforming fluid supply system provides pressurized fluid into an interior of the tube blank in order to expand the tube blank outwardly into conformity with the die cavity. A punch extends within a passage of at least one of the die structures. The punch is movable between retracted and extended positions. A punch driving assembly drives the punch between the retracted and extended positions to punch a hole into the expanded tube blank. A flushing system communicates with the die cavity providing a flushing fluid flow through the interior of the expanded tube blank.

16 Claims, 6 Drawing Sheets

HYDROFORMING FLUSH SYSTEM

This application is the National Phase of International Application PCT/CA01/00164 filed Feb. 13, 2001 which designated the U.S. This application is also based on U.S. Provisional Application Ser. No. 60/183,783, filed on Feb. 22, 2000, the entire contents of which are hereby incorporated herein by reference thereto.

FIELD OF INVENTION

This invention relates to a system for flushing hydroformed parts to remove debris from inside the part.

BACKGROUND OF THE INVENTION

In recent years, hydroforming technologies have become more and more important in manufacturing, particularly in the automotive industry. In one application of hydroforming, a tubular metal blank (usually steel) is placed in a die cavity. The opposite ends of the tube are sealed by a pair of hydraulic rams having central ports through which extremely high pressure fluid is injected into the tube. The high pressure fluid expands the tube into conformity with the surfaces defining the cavity. As a result of this hydroforming process, high strength parts can be made into complex tubular shapes that could otherwise not be achieved in any practical economic fashion. Such hydroforming processes are disclosed in U.S. Pat. Nos. 4,567,743; 5,070,717; 5,107,693; 5,233,854; 5,239,852; 5,333,755; and 5,339,667.

In even more advanced forms of hydroforming, the hydraulic rams are forced inwardly toward one another to create metal flow within the tube as the tube is being expanded in order to maintain the wall thickness of the tube within a predetermined range throughout the expansion process. Such hydroforming processes are disclosed in U.S. Pat. Nos. 5,718,048; 5,855,394; 5,899,498; 5,979,201; and 5,987,950.

For certain applications, it is desirable to produce a finished part that has a plurality of holes therein that can be used to mount other components. For example, in the automotive industry it is known to hydroform a tubular blank in order to form an engine cradle assembly used to mount an automotive engine. The finished tubular part must be provided with holes to enable fasteners to pass therethrough for mounting engine mounting brackets and the like. To facilitate the provision of holes in the part, it is known to perform a hole piercing operation in the hydroforming die itself. Typically, a hole is punched through the tube while under pressure. In one method, the portion of the tube cut out by the punch (sometimes referred to as the "slug") has an edge portion thereof left connected to the tube, depending into the tube. This is problematic because it adds unnecessary weight to the part, which is always a concern in the automotive industry. In another method, after the hole is formed, the punch is withdrawn out of the tube, and formed by the punch is maintained in engagement with the punch under the force of fluid pressure as the punch is withdrawn from the tube. The slug is then flushed by fluid to a scrap collector. One such typical operation is disclosed by U.S. Pat. No. 5,816,089. One problem associated with the aforementioned technique is that on occasion the slug does not exactly align with the hole it came from as it is withdrawn and may fall into the tube. It must then be retrieved by other means.

SUMMARY OF THE INVENTION

It is an object of the present invention to a system for removing scrap from an interior of a hydroformed part.

Accordingly, the present invention provides a hydroforming assembly that has a plurality of die structures mounted on a press for reciprocating movement between open and closed conditions. The die structures have cooperating die surfaces defining a die cavity when in the closed condition and receive a metallic tube blank when in the open condition. A hydroforming fluid supply system has tube-end engaging structures that are movable to selectively and sealingly engage opposite ends of the tube blank. The hydroforming fluid supply system provides pressurized fluid into an interior of the tube blank in order to expand the tube blank outwardly into conformity with the die cavity. A punch extends within a passage of at least one of the die structures. The punch is movable between retracted and extended positions. A punch driving assembly drives the punch between the retracted and extended positions to punch a hole into the expanded tube blank. A flushing system communicates with the die cavity providing a flushing fluid flow through the interior of the tube blank.

According to another aspect of the invention, there is provided a method of forming a hole in a hydroformed metallic tube blank and removing a punched scrap therefrom. A plurality of die structures is provided on a press for reciprocating movement between open and closed conditions. The die structures have cooperating die surfaces defining a die cavity when in the closed condition. The die structures are provided in the open condition. A metallic tube blank is placed into the die cavity. The die structures are closed. An interior of the tube blank is pressurized with a fluid so as to expand the tube blank into conformity with the die cavity and thus form an expanded tube blank. A punch is forced through the expanded tube blank so as to punch a hole therein. The interior of the expanded tube blank is depressurized. Fluid is flowed through the expanded tube blank so as to flush a punched portion of expanded tube blank out from the interior thereof.

DETAILED DESCRIPTION OF THE PREFERRED EMBODIMENT

Figure 1:
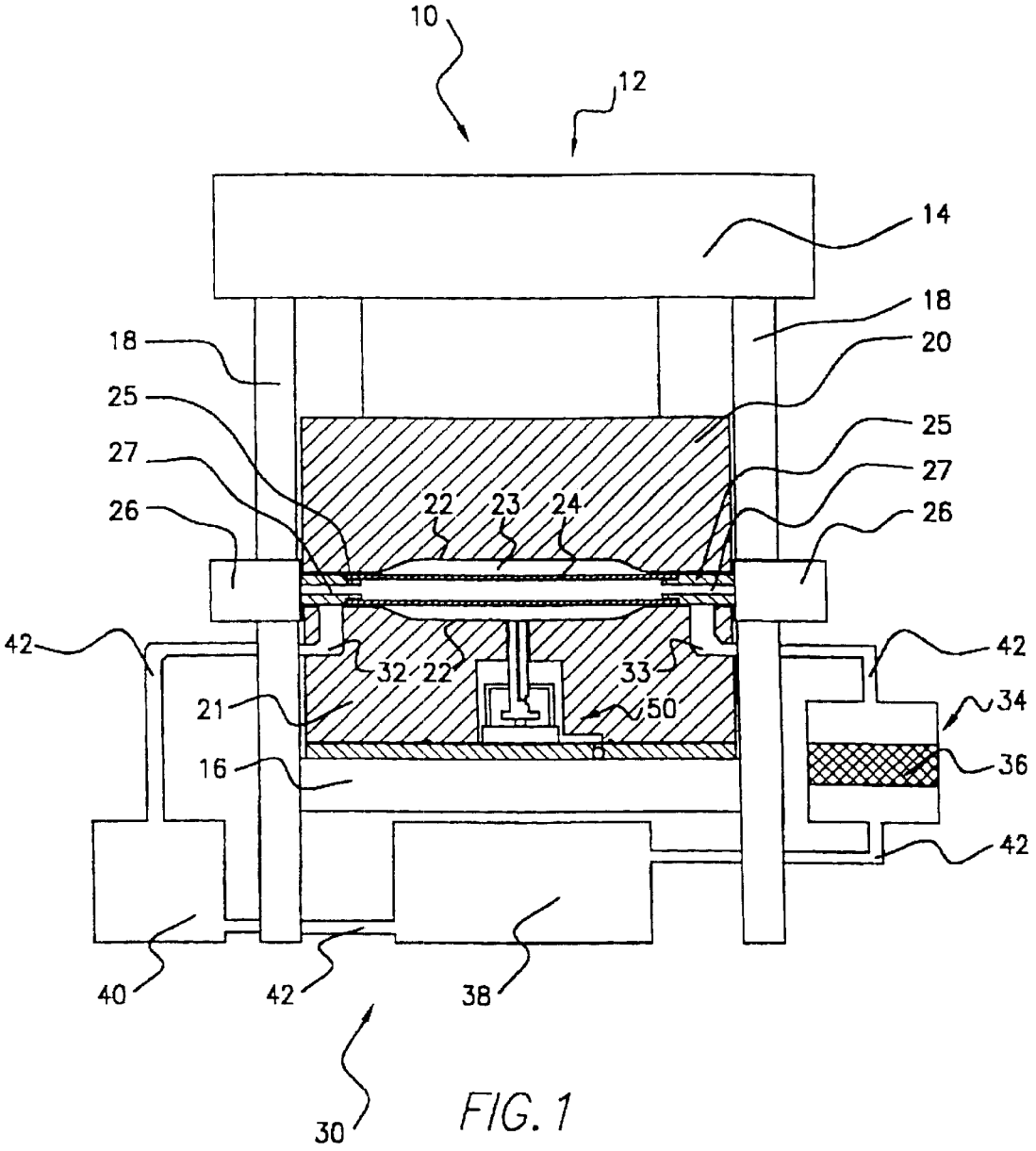
FIG. 1 is a schematic cross sectional view of the hydroforming apparatus having an in-die hydropiercing, and slug disengaging system in accordance with the principles of the present invention, and showing a tubular metallic blank inserted into the hydroforming apparatus in preparation for hydroforming.

Referring now more particularly to the drawings, there is shown therein in FIG. 1 a schematic cross-section view of a hydroforming apparatus generally indicated at 10, which embodies the principles of the present invention. The hydroforming apparatus 10 includes a hydroforming press, generally indicated at 12, with an upper support structure 14, a lower support structure 16, and vertical support structures 18. The hydroforming apparatus 10 is equipped with cooperating die structures, which may include an upper die structure 20, and a lower die structure 21. The upper die structure 20 can be raised and lowered so that the die structures 20, 21 are moveable between open and closed positions. The die structures 20, 21 are shown in the closed position in FIG. 1. The dies 20, 21 provide die surfaces 22, defining a sealed die cavity 23 when the dies 20, 21 are in the closed position. The shape and size of the die cavity 23 is configured to form the desired shape and size of the part to be hydroformed. FIG. 1 shows a tubular metal blank 24, which has been placed into the die cavity 23 to be hydroformed. The opposite ends of the tubular metal blank 24 are sealingly engaged by a pair of hydraulic tube-end engaging structures, or "hydraulic rams" 25, which are movable into varied positions driven by a hydraulic actuator 26. Each ram 25 has a cental port 27 through which extremely high pressure hydroforming fluid (e.g., approximately 10,000 atms.) is injected into the tubular metal blank 24.

Figure 3:
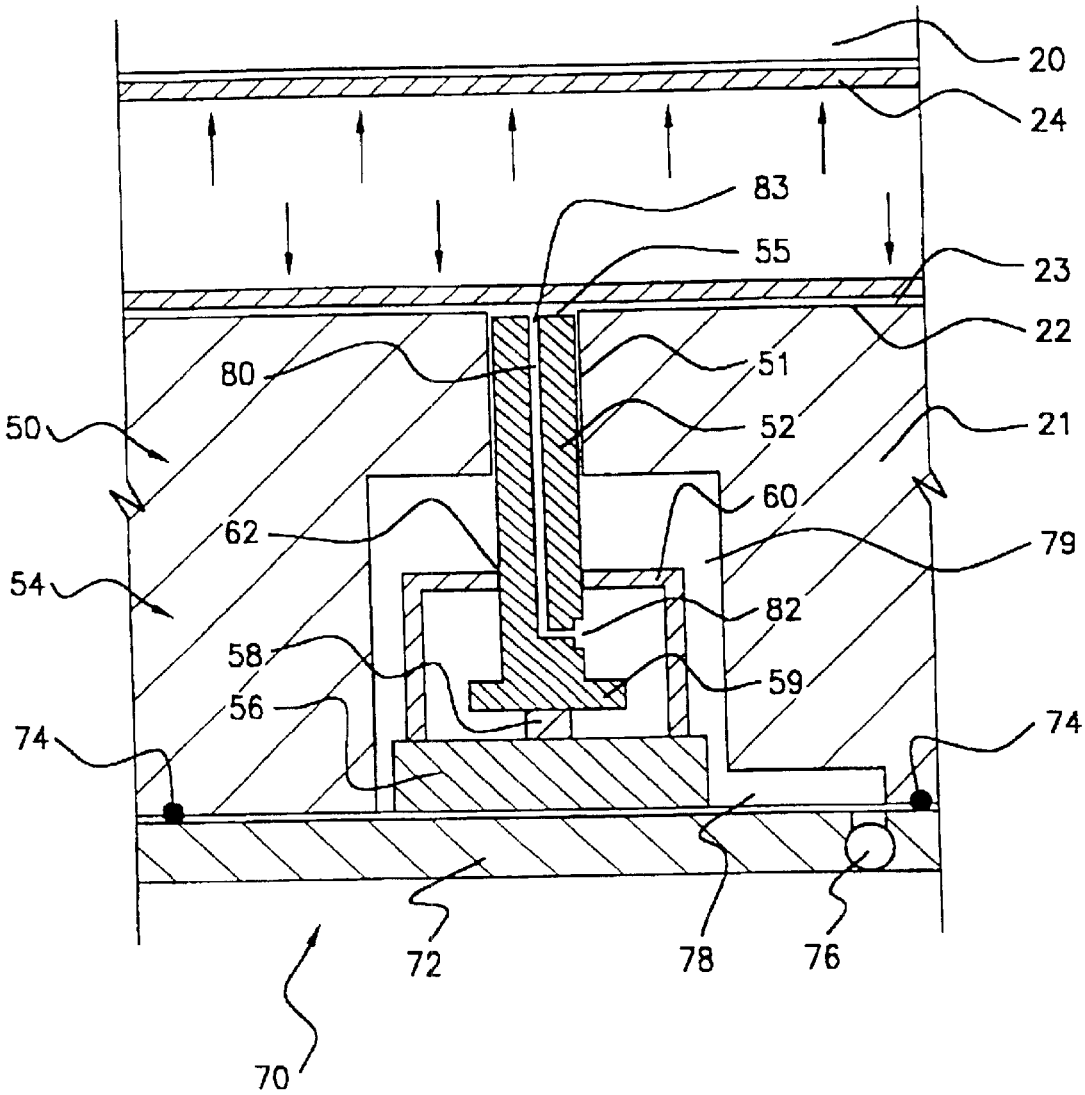
FIG. 3 is an enlarged partial view of the hydroforming apparatus shown in FIG. 2 providing a detailed view of a hydropiercing punch assembly with the punch in the retracted position.

Incorporated into at least one of the die structures 20, 21, is a reciprocating hydropiercing punch assembly, generally indicated at 50, which is shown in detail in FIG. 3.

Figure 4:
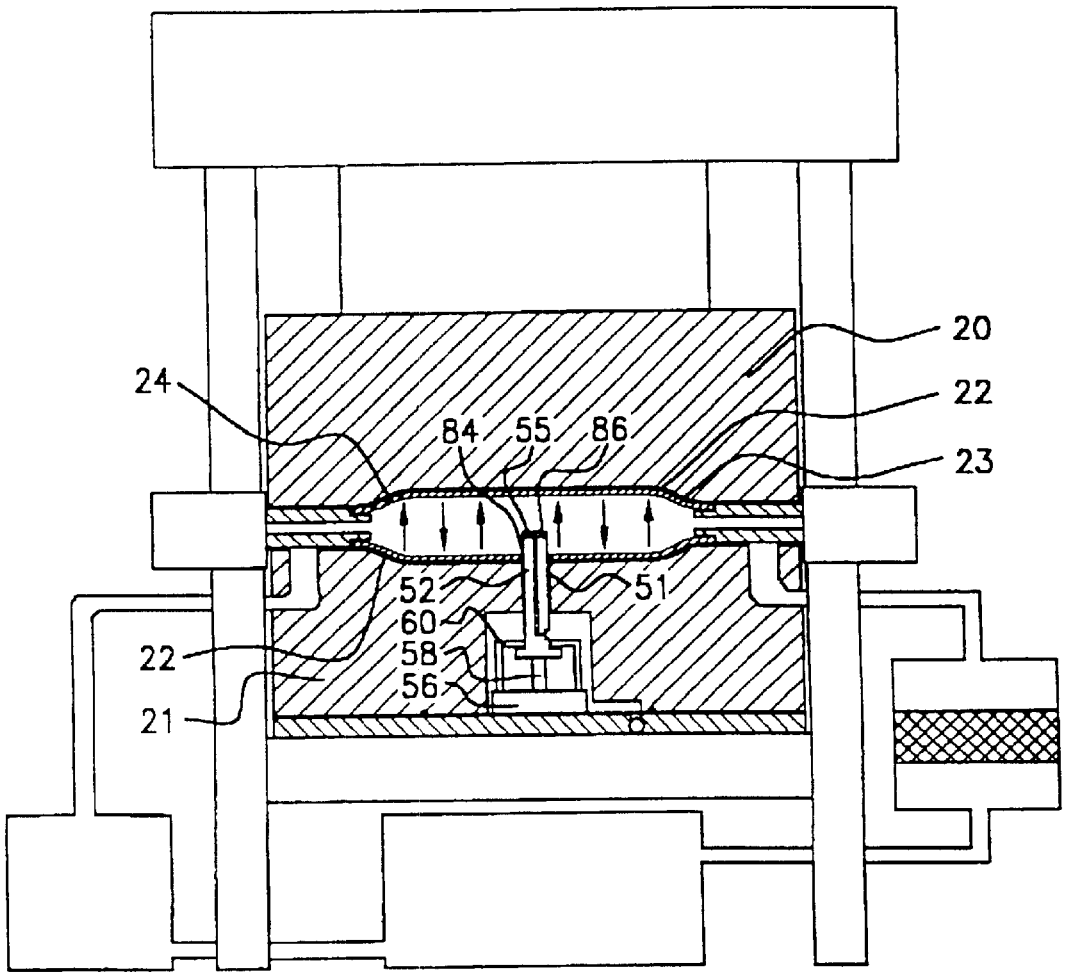
FIG. 4 is similar to FIG. 2, but shows the punch in its extended position after punching a hole into the expanded metallic tube.

The hydroforming apparatus 10 is equipped with a flushing fluid system, generally indicated at 30, which communicates with the die cavity 23. The flushing fluid system 30 is used to remove at least one punched out portion, or "slug" 86, of the expanded metallic tube 24, (as shown in FIG. 4). The flushing fluid system 30 includes a flushing fluid inlet port 32 which is located at on e end of the die cavity 23 and a flushing fluid outlet port 33 which is located at the opposite end of the die cavity 23. Preferably, both of these ports 32 and 33 are formed into the lower die structure 21 as shown. The flushing fluid system 30 preferably includes a scrap separator generally indicated at 34 with a mesh or screen 36. Also, the flushing fluid system preferably includes a fluid reservoir 38 which can be used for storing and/or recycling the flushing fluid, if desired. The flushing fluid system 30 also includes connecting plumbing lines 42 and a circulator 40 for circulating the flushing fluid through the flushing fluid system 30.

Referring now to FIG. 3, the hydropiercing punch assembly 50, is shown in greater detail. The punch assembly 50 is used to punch a hole 84 (as shown in FIG. 4) into the expanded metallic tube 24. Any number of similarly designed punch assembly 50 may be incorporated into one or more of the die structure(s) 20, 21. The punch assembly 50 includes a punch receiving passage 51 that is incorporated into the die structure(s) and through which a punch 52 may be moved between a retracted and an extended position. The punch 52 is movable in slidable, sealed relation with respect to the passage 51 by virtue of an annular seal member 53 therebetween. The punch assembly 50 includes a punch driver assembly generally indicated at 54, which is used to drive the punch 52 between the retracted and extended positions. In the retracted position, the distal end surface 55 of the punch 52 is flush with the die surfaces 22, and helps to define the die cavity 23. The punch driver assembly 54 includes a punch driver 56, which may be a hydraulic cylinder, that is connected to a punch piston 58. The proximal end 59 of the punch 52 is secured to and connected to the punch piston 58. The punch piston 58 is movable between a retracted and an extended position. The punch 52 traverses through an opening 62 in a punch driver housing 60 in slidable relation with respect to the opening 62.

The flushing fluid system 30 may include a slug disengaging system, generally indicated at 70, which can provide a means of disengaging the slug 86 from the end working surface 55 of the punch 52. At least one of the die structures 20, 21 is mounted to a slug disengaging fluid bulkhead 72. A peripheral seal 74 between the die structure 20, 21 and the bulkhead 72 surrounds the slug disengaging system 70 so that the slug disengaging system 70 is sealed from atmosphere and can be pressurized with slug disengaging fluid. The slug disengaging system 70 includes a slug disengaging fluid input port 76 which is located on the slug disengaging fluid bulkhead 72. The slug disengaging fluid input port 76 can be connected to any suitable high pressure pump to provide pressurized slug disengaging fluid to the slug disengaging system 70. The slug disengaging fluid input port 76 is connected to a slug disengaging fluid passageway 78 which can be common to several punch assemblies 50. The passageway 78 can be any suitably sized groove formed into the die structure(s) 20, 21. The passageway 78 communicates with a slug disengaging fluid pressure chamber 79 that can be formed into the die structure(s) 20, 21. The punch 52 includes a slug disengaging fluid port 80 which traverses longitudinally through the punch 52. The slug disengaging fluid port 80 originates at a slug disengaging fluid inlet 82 located on the side of the punch 52 and terminates with an outlet 83 at the punch working surface 55. The slug disengaging fluid inlet 82 can be located so as to communicate with the slug disengaging fluid pressure chamber 79 when the punch 52 is in the extended position so that the slug disengaging fluid port 80 can be pressurized with slug disengaging fluid as desired.

Figure 2:
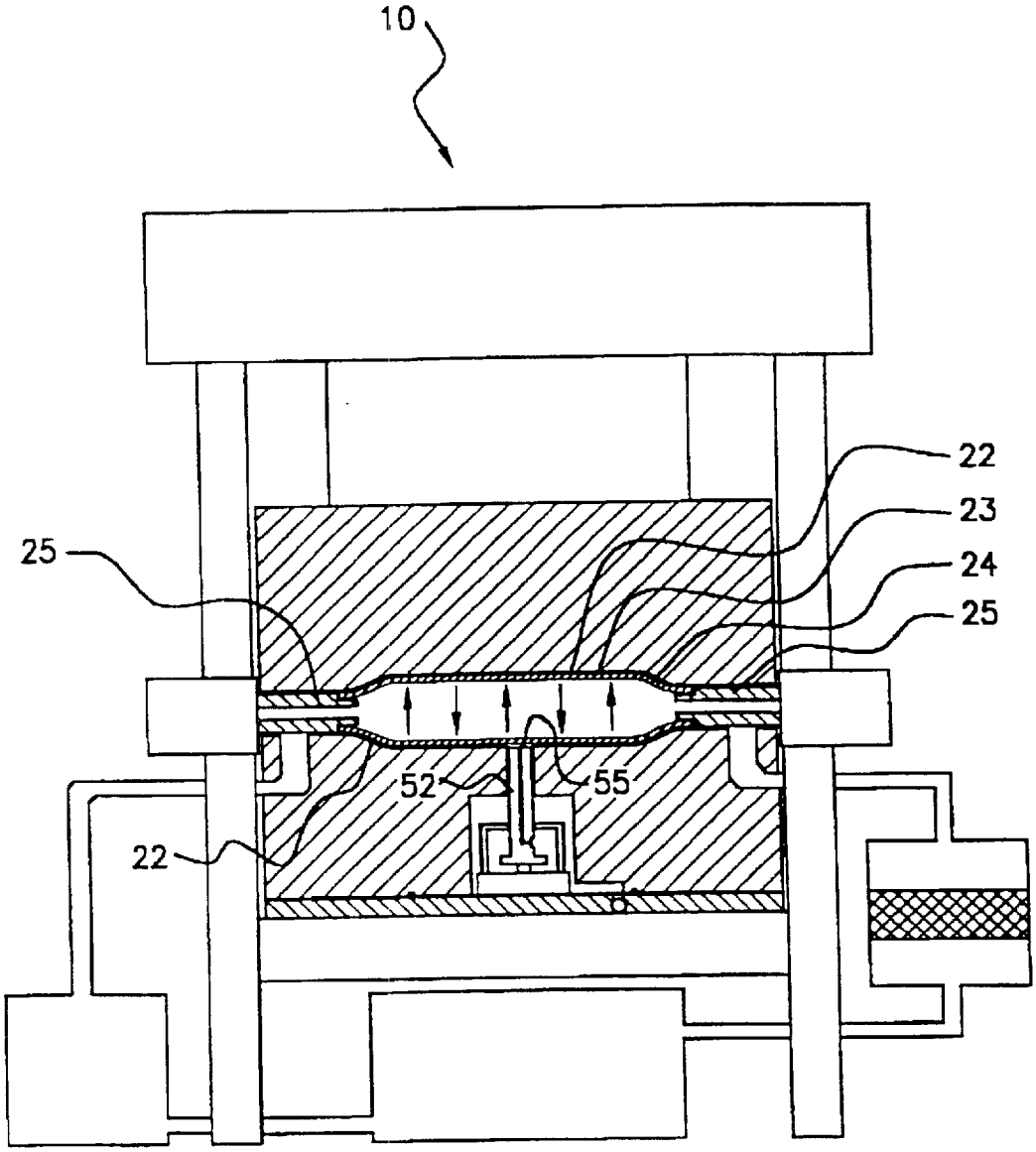
FIG. 2 is similar to FIG. 1, but shows the expanded metallic tube after hydroforming.

Operation of the hydroforming apparatus 10 will now be described. Referring to FIG. 2, the metallic tube 24 is expanded under hydroforming fluid pressure into conformity with the inner surfaces 22 of the die cavity 23 and into engagement with the working surface 55 of the punch 52 which is in the retracted position. So as to maintain predetermined wall thickness of the expanded metallic tube 24, the hydraulic rams 25 are forced inwardly toward one another to create metal flow within the tube 24 as the tube 24 is being expanded.

In FIG. 4, the punch driver or cylinder 56 is actuated and drives the punch piston 58 into the extended position. This action drives the punch 52 from the retracted position to the extended position after the metallic tube 24 has been expanded into conformity with the die surfaces 22, thus forcing the punch 52 through the expanded metallic tube 24 so as to punch a hole 84 in the expanded metallic tube 24, and so as to form the slug 86. Hydroforming fluid is maintained under high pressure within the expanded metallic tube 24 to provide interior support to the tube 24 during the hole punching sequence in order to prevent deformation of the expanded metallic tube 24 by the punch 52 at areas adjacent to the punched hole 84. The die structures 20, 21 are maintained in the closed position, and the expanded metallic tube 24 maintains engagement with the surfaces 22 of the die cavity 23. In the extended position, the punch 52 serves to seal the hole 84 that has been punched into the tube 24 thus aiding to maintain fluid in the tube 24 so as to inhibit the escape of fluid from the tube 24 during a subsequent slug flushing operation.

Figure 5:
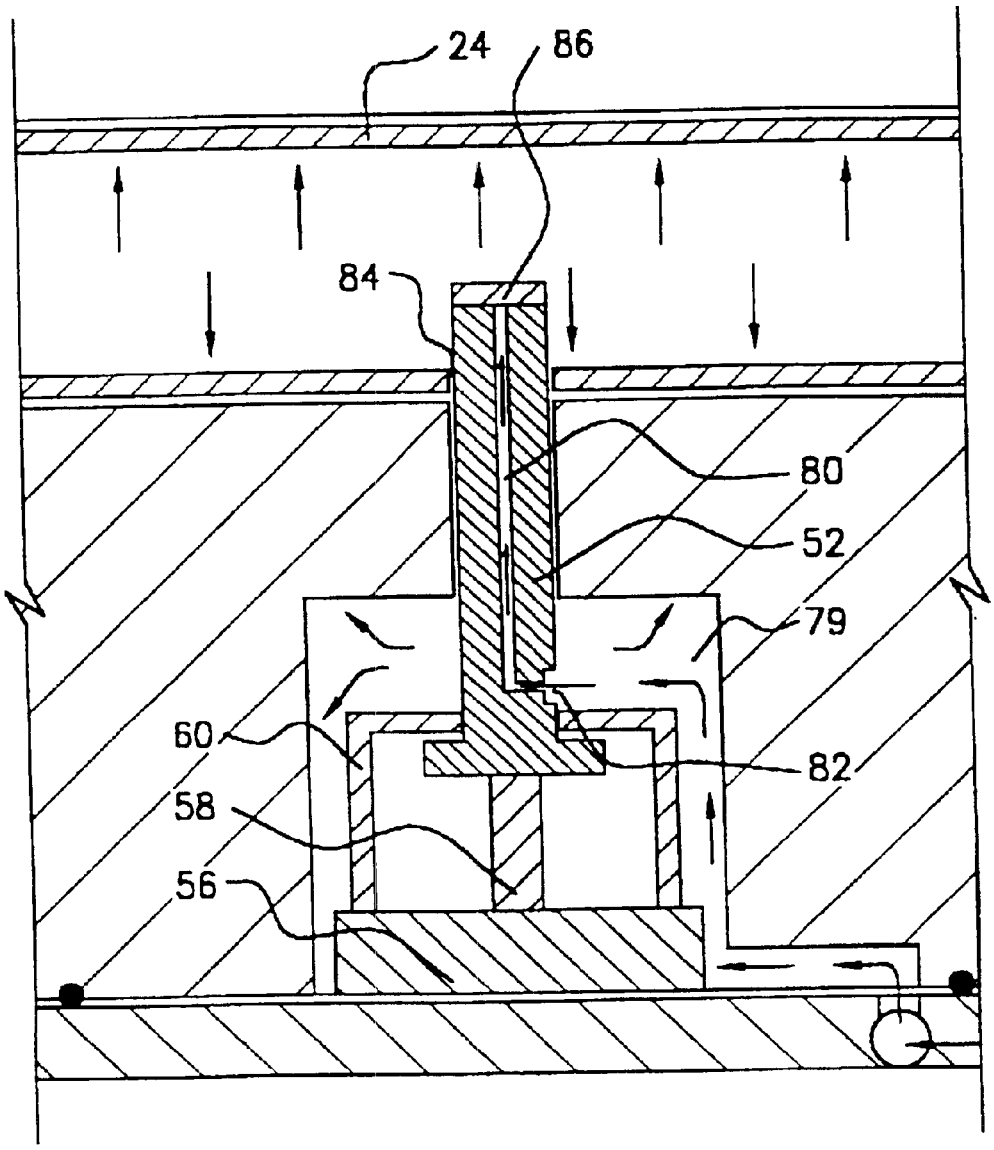
FIG. 5 is an enlarged partial view similar to FIG. 3, but showing the punch in an extended position after punching a hole into the expanded metallic tube; and, FIG. 6 is similar to FIG. 4, but showing a punched slug being flushed out of the expanded metallic tube.

FIG. 5 shows the punch 52 in the extended position in greater detail. The slug disengaging fluid inlet 82 communicates with the slug disengaging fluid pressure chamber 79 thus permitting flow of the slug disengaging fluid through the slug disengaging fluid port 80.

Figure 6:
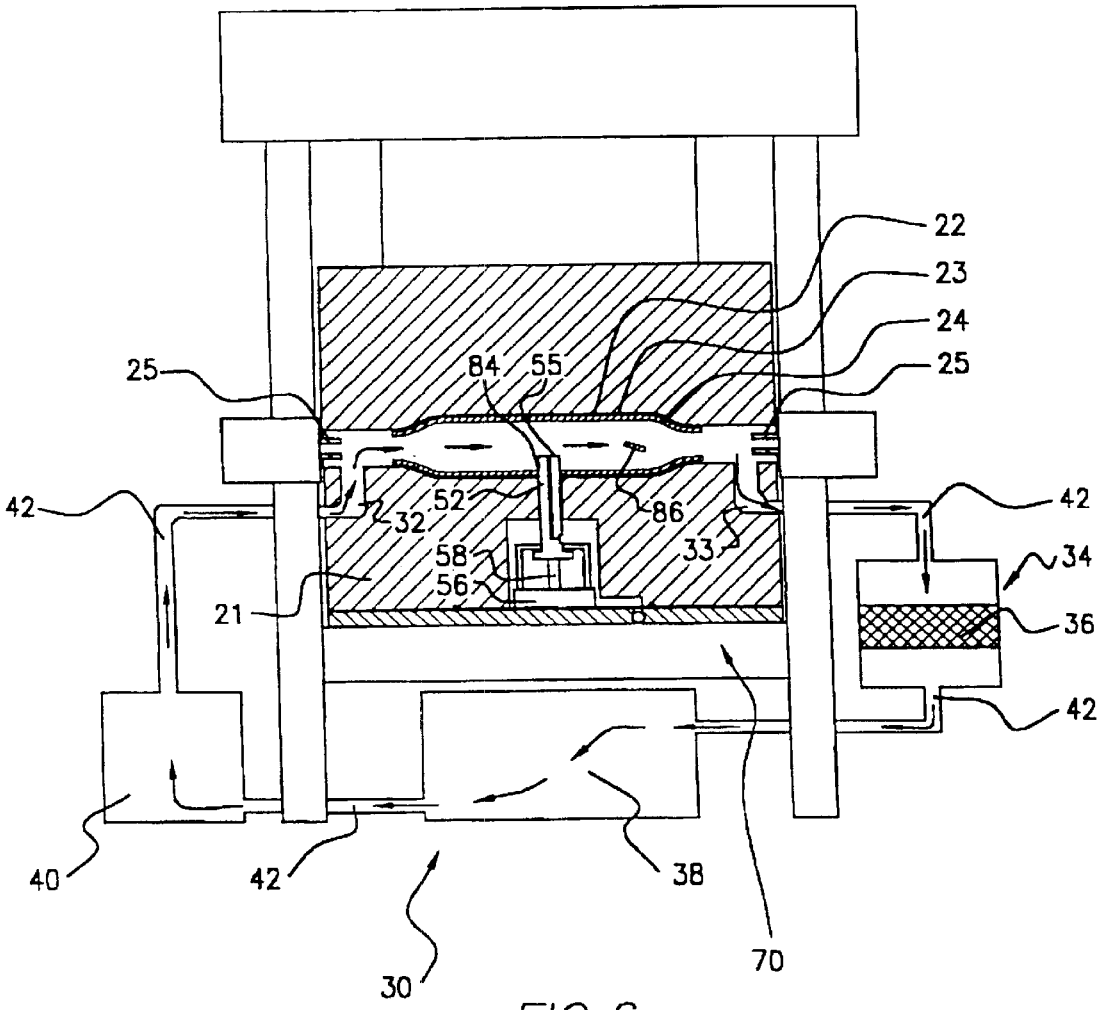

Referring now to FIG. 6, at least one of the hydraulic rams 25, that is, at least the ram adjacent to the outlet port 33, but preferably both rams, is movable out of sealed engagement with the end(s) of the expanded metallic tube 24, thus permitting the hydroforming fluid in the tube 24 to become depressurized. The hydraulic rams 25 are now positioned so as to facilitate flow of flushing fluid and removal of the slug 86 from the tube 24. The die structures 20, 21 remain in the closed position and the flushing fluid system 30 communicates with the die cavity 23 to provide flow of flushing fluid to the interior of the expanded metallic tube 24.

Typically, the slug 86 may remain engaged to the end working surface 55 of the punch 52. If this is the case, the invention provides various means for disengaging the slug 86 from the end working surface 55 of the punch 52.

In one embodiment, the slug 86 can be forcibly disengaged from the end surface 55 of the punch 52 by pressurization of the slug disengaging system 70 which forces fluid through the fluid port 80 and detaches the slug 86 from the working surface 55 of the punch 52. Alternatively, the punch driver 56 may be used to rapidly reciprocate the punch 52 to disengage the slug 86 from the working surface 55 of the punch 52.

In yet another embodiment, the slug 86 can be forcibly disengaged from the end working surface 55 of the punch 52 solely by rapid flow of flushing fluid through the tube 24 as provided by the flushing fluid system 30.

The flushing fluid circulator 40 and the connecting plumbing lines 42 provide sufficiently high flow rate of flushing fluid so as to flush the detached metal slug 86 through the expanded metallic tube 24 and to remove the slug 86 from the tube 24. The flushing fluid flows through the inlet port 32, passes through the tube 24 and carries the slug 86 out through the opposite end of the tube 24 and out through the outlet port 33. The outlet port 33 and the connecting plumbing lines 42 are suitably sized with wide enough inner diameter so as to permit the unobstructed flow of the flushing fluid and the slug 86 out of the die 21. Once the metal slug 86 is removed from the die 21, the slug 86 can be separated from the flushing fluid by the mesh or screen 36 in the scrap separator 34, and the fluid can be recovered into the fluid reservoir 38. During the flushing fluid sequence, the punch 52 is maintained in the extended position so as to prevent leakage of flushing fluid through the punched out hole 84 in the tube 24.

While the invention has been illustrated and described in detail in the drawings and foregoing description, the same is to be considered as illustrative and not limiting in character, it being understood that the preferred embodiment has been shown and described and that all changes and modifications that come within the scope of the appended claims are to be protected.

What is claimed is:

1. A hydroforming assembly, comprising:

a plurality of die structures mountable on a press for reciprocating movement between open and closed conditions, said die structures having cooperating die surfaces defining a die cavity when in the closed condition, said die structures receiving a metallic tube blank when in the open condition;

a hydroforming fluid supply system having tube-end engaging structures that are movable to selectively and sealingly engage opposite ends of said tube blank, said hydroforming fluid supply system providing pressurized fluid into an interior of said tube blank in order to expand the tube blank outwardly into conformity with said die cavity into an expanded condition, a punch extending within a passage of at least one of said die structures, said punch movable between retracted and extended positions;

a punch driving assembly operably connected with said punch to drive said punch between said retracted and extended positions to punch a hole into said tube blank after said tube blank has been expanded into said expanded condition; and a flushing system communicating with said die cavity providing a flushing fluid flow through the interior of said tube blank.

2. A hydroforming assembly as claimed in claim 1, wherein said punch has a working surface, said working surface being co-planar with a die surface of said die cavity when said punch is in said retracted position, and said working surface extends into said die cavity when in said extended position.

3. A hydroforming assembly according to claim 2, wherein the punch has a fluid passageway in communication with the working surface of the punch, the fluid passageway communicating with a source of pressurized fluid which can be expelled through said fluid passageway so as to urge a punched portion of said tube blank away from said working surface of the punch.

4. A hydroforming assembly as claimed in claim 3, wherein said fluid passageway communicates with said source of pressurized fluid when said punch is in said extended position.

5. A hydroforming assembly as claimed in claim 4, wherein said punch driving assembly includes a housing having an opening and said punch extends through said opening.

6. A hydroforming assembly as claimed in claim 5, wherein an interior of said housing is isolated from said source of pressurized fluid and said fluid passageway has an inlet positioned such that the inlet communicates with the interior of the housing when the punch is in the retracted position and the inlet is positioned out of the housing when the punch is in the extended position.

7. A hydroforming assembly as claimed in claim 6, wherein said pressurized fluid is a gas.

8. A hydroforming assembly according to claim 1, wherein said punch is retained in said extended position during said flushing fluid flow.

9. A hydroforming assembly according to claim 1, wherein said punch is reciprocated during said flushing fluid flow.

10. A hydroforming assembly according to claim 1, wherein said tube-end engaging structures retract from engagement with ends of said tube blank to open communication of said flushing system with the interior of the tube blank.

11. A hydroforming assembly according to claim 1 wherein said flushing system comprises, a scrap separator receiving said flushing fluid flow from said die cavity, a fluid reservoir providing a source of fluid for said flushing fluid flow and a circulator for effecting said flushing flow.

12. A method of forming a hole in a hydroformed metallic tube blank and removing a punched scrap therefrom, said method comprising:

providing a plurality of die structures mounted on a press providing reciprocating movement between open and closed conditions, said die structures having cooperating die surfaces defining a die cavity when in the closed condition, said die structures being in the open condition;

placing a metallic tube blank into said die cavity;

closing the die structures;

pressurizing an interior of said tube blank so as to expand said tube blank into conformity with said die cavity and thus form an expanded tube blank;

forcing a punch through said tube blank so as to punch a hole in said expanded tube blank;

depressurizing the interior of said expanded tube blank; and flushing fluid through said expanded tube blank so as to flush a punched portion of expanded tube blank out from the interior of said expanded tube blank.

13. A method according to claim 12, wherein the punch has a fluid passageway in communication with a working surface of the punch, and the method includes a step of providing pressurized fluid through said fluid passageway so as to urge a punched portion of said expanded tube blank away from said working surface of the punch.

14. A method according to claim 12, wherein method includes a step of reciprocating said punch during said step of flushing fluid.

15. A method according to claim 12, wherein said step of depressurizing includes a step of opening communication of said flushing system with the interior of the expanded tube blank.

16. A method according to claim 12, wherein said punch is retained in an extended position extending into the interior of said expanded tubular blank during said step of flushing fluid.

* * * * *